US005392934A

United States Patent [19]

Fox

[11] Patent Number: 5,392,934

[45] Date of Patent: Feb. 28, 1995

[54] APPARATUS AND METHOD FOR ADJUSTABLY SUPPORTING FURNISHINGS ON A WALL SURFACE

[76] Inventor: Larry G. Fox, 3529 S. 163rd St., Omaha, Nebr. 68130

[21] Appl. No.: 62,114

[22] Filed: May 14, 1993

[51] Int. Cl.[6] ..... A47F 5/00

[52] U.S. Cl. ..... 211/94; 211/88; 211/103; 248/225.2; 312/245

[58] Field of Search ..... 211/87, 88, 94, 103; 248/225.2; 312/245, 246, 247

[56] References Cited

U.S. PATENT DOCUMENTS

| | | | |
|---|---|---|---|
| 2,992,743 | 7/1961 | Wing | 211/94 X |
| 4,133,507 | 1/1979 | Chervenak | 248/225.2 |
| 4,311,295 | 1/1982 | Jamar | 248/225.2 X |
| 4,329,003 | 5/1982 | Manchester | 248/225.2 X |
| 4,401,222 | 8/1983 | Kulikowski et al. | 211/94 |
| 4,457,436 | 7/1984 | Kelley | 211/94 X |
| 5,050,832 | 9/1991 | Lee et al. | 248/225.2 |
| 5,123,549 | 6/1992 | Finses et al. | 211/94 X |
| 5,222,611 | 6/1993 | Wood et al. | 211/94 |

*Primary Examiner*—Robert W. Gibson, Jr.
*Attorney, Agent, or Firm*—Philip J. Lee

[57] ABSTRACT

An apparatus for height adjustably supporting an object on a wall surface includes a horizontal wall mount spacer section adapted to be mounted adjacent a wall surface. An object support rail is adapted to be mounted adjacent the wall mount spacer section opposite the wall surface, the wall mount spacer section and object support rail mounted in substantially parallel alignment. The support rail has a saddle-receiving upper surface spaced from the wall mount spacer section. At least one object-supporting saddle bracket is provided, the bracket adapted to fit over and be supported by the upper surface of the support rail, each bracket further including engagement hooks for engaging and supporting an object adjacent the outer side of the support rail. Mounted on the object to be supported is a receiving element such as a double slotted standard which will receive and retain the engagement hooks thus allowing an object to be supported by the wall mount apparatus.

12 Claims, 8 Drawing Sheets

APPARATUS AND METHOD FOR ADJUSTABLY SUPPORTING FURNISHINGS ON A WALL SURFACE

BACKGROUND OF THE INVENTION

1. Field of Invention

This invention relates to apparati and methods for supporting an object on a wall surface and, more particularly, to a method and apparatus for height adjustably supporting furnishings on a wall surface including a longitudinally extended wall mount section to which is mounted a longitudinally extended object support rail having an upper surface to receive a saddle bracket to which an object to be supported is mounted.

2. Description of Related Art

Various systems have been proposed for mounting objects on a wall. However, each of these prior art devices includes some inherent disadvantages which detract from their usefulness.

For example, Chervenak, U.S. Pat. No. 4,133,507, discloses a system for mounting storage units to a wall including a wall rail defining a U-shaped channel and a mounting key. The mounting key is formed of two legs, the first leg being securely held within the wall rail channel and the second leg slidably engagable with upwardly extending horizontal slots located in the rear of a storage unit. Additionally, a leveling key may be used to keep the storage unit in a level condition.

Chervenak clearly requires substantial modification of objects to be supported by the mounting system, as upwardly extending horizontal slots must be added to the rear surface of the object to be supported. Such modifications are both unsightly and impractical for use with cabinetry and other such furniture. Furthermore, the mounting key only engages the object to be supported in one location, specifically in a single horizontal slot. Therefore, no redundancy is provided to prevent a supported object from disengaging from this single contact point and falling to the ground. There is therefore a need for an object support system requiring only minor modifications to objects to be supported therefrom and which will provide more than a single contact support point.

Other such wall rail systems have been proposed, including Kelley, U.S. Pat. No. 4,457,436, and Wyatt, British Patent No. 2,206,033, however, these devices do not provide for height adjustment without major modifications to either the support structure or the object being supported. There is therefore a need for a device which will provide for a safe, efficient heights adjustment of objects being supported thereon.

Therefore, an object of the present invention is to provide an improved apparatus, method and system for adjustably supporting an object on a wall surface.

Another object of the present invention is to provide an apparatus for adjustably supporting an object on a wall surface which can quickly and easily be adapted to fit almost any object to be supported, including cabinetry and furniture.

Another object of the present invention is to provide an apparatus for adjustably supporting an object on a wall surface which will provide for simple and efficient height adjustment.

Another object of the present invention is to provide an apparatus for adjustably supporting an object on a wall surface which uses a bracket which is designed to engage a commercially available double-slotted standard.

Another object of the present invention is to provide an apparatus and method for height adjustably supporting an object on a wall surface wherein the connection between the bracket and standard has more than one point of contact to provide safety through redundancy.

Another object of the present invention is to provide an apparatus for height adjustably supporting an object on a wall surface which may be quickly and simply modified to accommodate a hand rail for use in residences or the like.

Finally, an object of the present invention is to provide an apparatus, system and method for height adjustably supporting an object on a wall surface which is relatively simple to manufacture and install and is safe and efficient in use.

Other objects and advantages of the invention may become apparent from the Description of the Preferred Embodiments and the Drawings and may be in part pointed out in more detail hereinafter.

The invention consists of the features of construction, combination of elements and arrangement of parts exemplified in the construction hereinafter described and the scope of the invention will be indicated in the appended claims.

SUMMARY OF THE INVENTION

The present invention is designed to furnish a safe practical system to provide cabinetry and furniture that will be adjustable in height to comply with the Uniform Federal Accessibility Standards by the Architectural Barriers Act of 1968 as amended.

The present invention provides an apparatus for adjustably supporting an object on a wall surface including a longitudinally extended wall mount spacer having a center longitudinal axis and having inner and outer sides, the inner side adapted to be mounted adjacent a wall surface. Also included is a longitudinally extended object support rail having inner and outer sides and a center longitudinal axis, the inner side of the support rail adapted to be mounted adjacent the outer side of the wall mount spacer, the center longitudinal axis of the object support rail aligned substantially parallel with the center longitudinal axis of the wall mount spacer. The support rail should extend upwards above the wall mount spacer thus forming a saddle-receiving upper surface. For mounting the object to be supported on the object support rail, at least one object-supporting saddle bracket is adapted to fit over and be supported by the upper surface of the support rail. Each saddle bracket includes one or more engagement hooks for engaging and supporting an object adjacent the outer side of the support rail. Finally, each object to be supported must include a receiving element such as a shelf standard having one or more vertical rows of slots which are designed to receive and retain the engagement hooks, thus enabling the object to be supported by the apparatus.

The present invention thus provides an apparatus for adjustably supporting an object on a wall surface which may be quickly and easily installed in virtually any room or building. A large variety of objects may be supported from the object support rail of the present invention, including cabinetry and other furniture such as desks or tables. As the only modification which need be made to objects to be supported by the present invention is to add a slotted standard to the rear surface of the object, the present invention requires substantially less modification to objects to be supported than those examples found in the prior art. Furthermore, the heights of the object being supported may be easily adjusted by merely moving the bracket to a different position on the slotted standard. Additionally, the present invention is ideally suited for rental apartments or the like, as a tenant may choose to include as many or as few desks, cabinets, tables or the like, as he or she chooses. Extra furnishings could be removed at the tenant's request, or added should the tenant choose to include other furnishings. The present invention also provides easier access for handicapped or infirm persons, thus complying with the Architectural Barriers Act, as mentioned above. The present invention furthermore provides for easier cleaning below cabinets, desks, or other such furnishings which are supported by the present invention. The present invention also allows for access to wall sockets and ducts on the lower areas of a vertical wall surface which would ordinarily be covered by ground-engaging furnishings. This allows for much greater flexibility in the placement and arrangement of furnishings within a room in which the present invention is installed. Therefore, the present invention provides a substantial improvement over those apparati found in the prior art. Furthermore, the present invention may be quickly and easily modified to accommodate a hand rail without destroying the appearance or finish of the object support rail. Such a modification allows for use of the present invention even when not supporting various objects. The functional uses of the present invention are therefore expanded thus increasing the cost efficiency of the entire apparatus.

DESCRIPTION OF THE PREFERRED EMBODIMENT(S)

Figure 1:
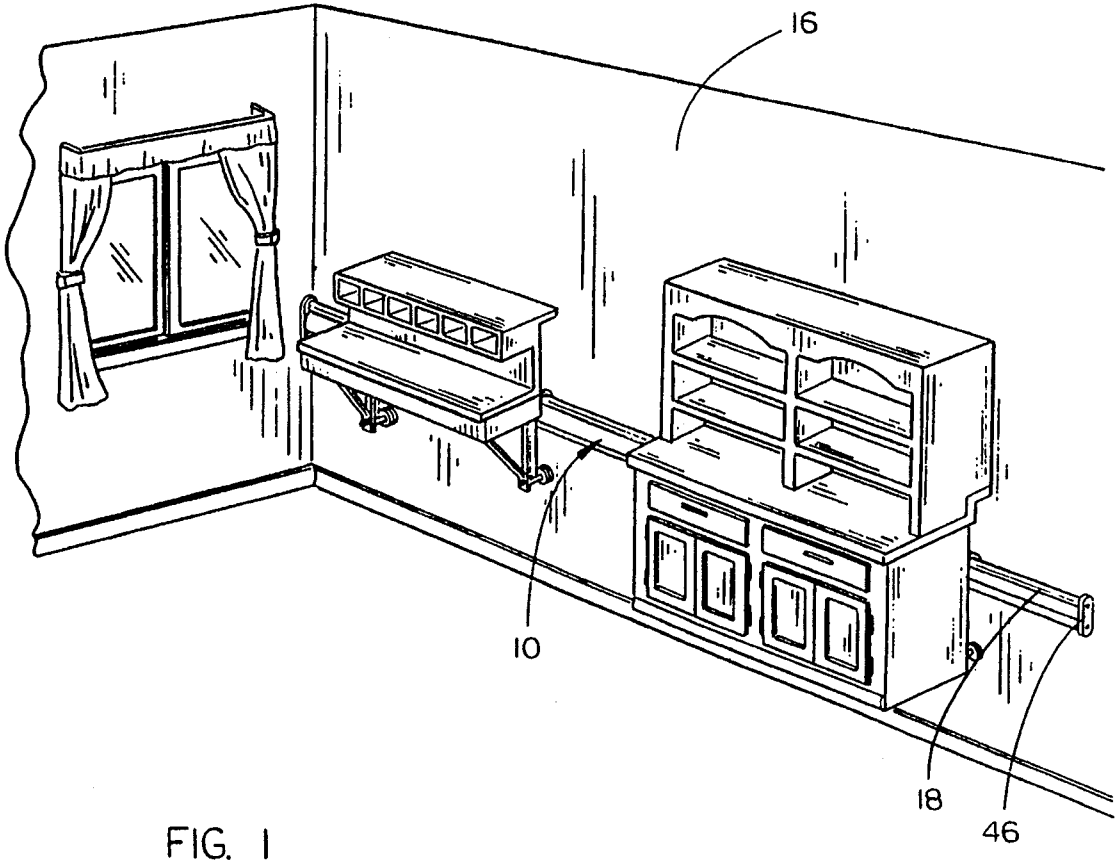
FIG. 1 is a perspective view of a room equipped with rails of the invention showing furnishings supported on one rail thereof.

The wall rail apparatus 10 of the present invention is shown in its preferred embodiments in FIGS. 1–6 as including a longitudinally extended wall mount spacer board 12 which, in the preferred embodiment, would be a standard one-inch by two-inch board having a slot 14 formed in the long side to be placed adjacent the vertical wall surface 16. It is to be understood that the exact dimensions of the wall mount spacer board 12 are not critical to the present invention, however, the wall mount spacer board 12 need merely act as a spacing device to support the object support rail 18. It is also preferred that the wall mount spacer board 12 be formed of a sturdy wood having a pleasing aesthetic effect, such as oak or another such hard wood. However, the wall mount spacer board 12 may also be constructed of extruded plastic or metal depending on the strength and flexibility desired in construction of the wall rail apparatus 10.

Figure 2:
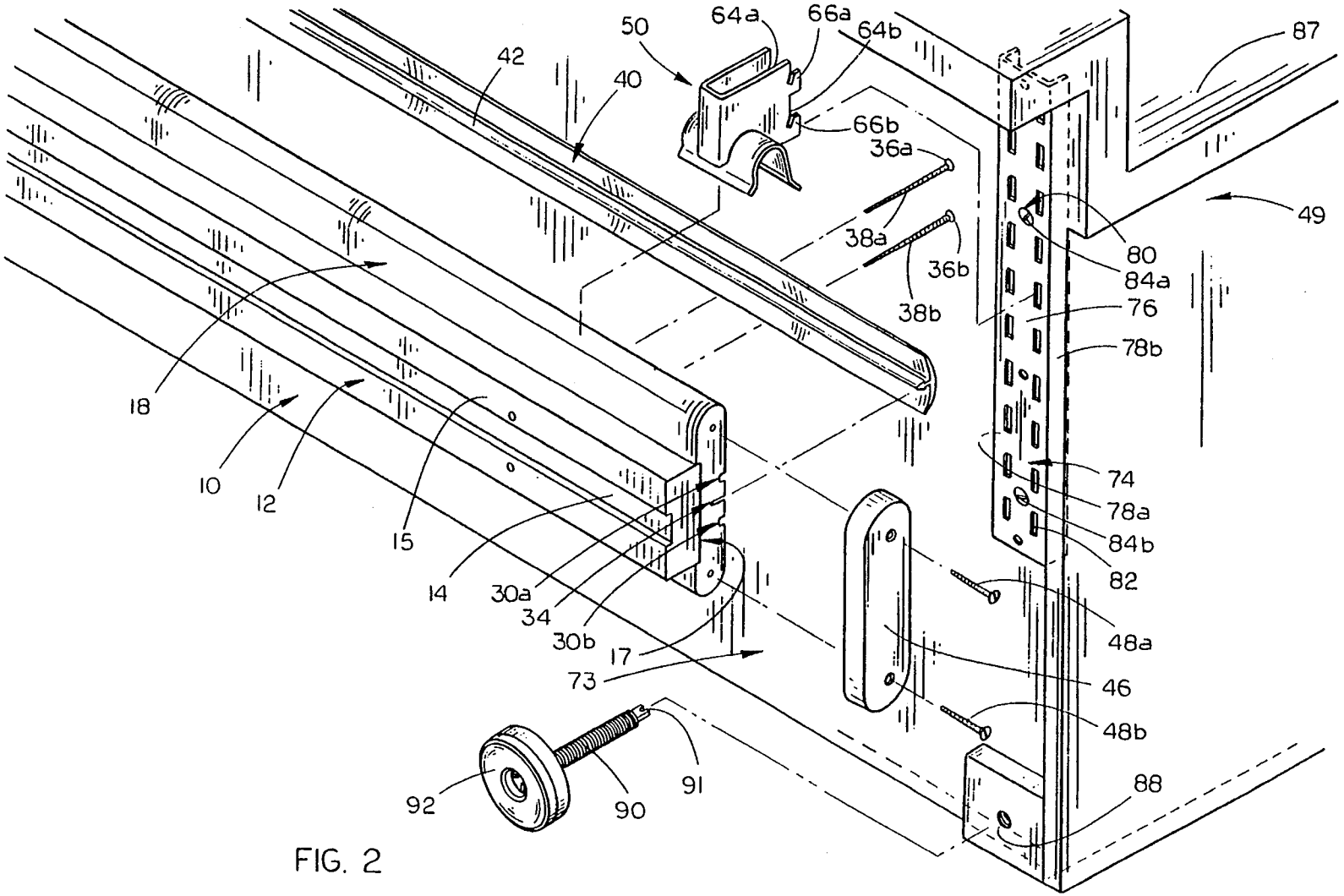
FIG. 2 is a rear exploded perspective view of the bumper rail support system in association with a cabinet.
Figure 4:
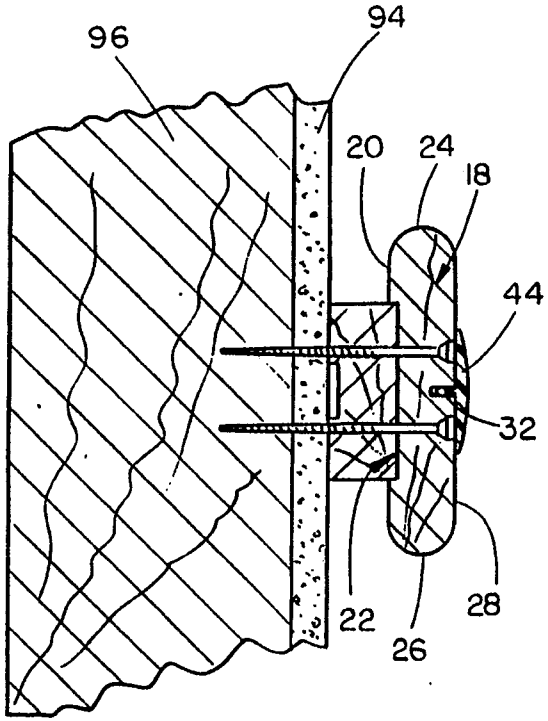
FIG. 4 is a partial side sectional view of the wall rail apparatus of the invention.

The object support rail 18 is preferably constructed of a 4-inch by 1-inch wood board. However, as was discussed above, these dimensions and construction materials are not critical to the invention, as any rigid, wear-resistant material may be employed. It is preferred that the object support rail 18 have an inner surface 20 having a dado 22 formed therein to accommodate the outer surface 17 of the wall mount spacer board 12. The dado 22 is a rectangular notch formed in the inner surface 20 of the object support rail 18, the dado 22 having a depth of approximately one-eighth inches and a height slightly greater than the height of the outer surface 17 of the wall mount spacer board 12 in order to allow the wall mount spacer board 12 to fit within the dado 11. This allows the connection between the wall mount board 12 and object support rail 18 to be substantially stronger as shown in FIGS. 2 and 4. Additionally, the wall mount spacer board 12 and object support rail 18 may be formed as a single, unitary structure to further increase the rigidity of the wall rail apparatus 10. The unitary structure may be molded or forged or cut depending on the construction material. However, it is preferred that the apparatus 10 be constructed as described above to provide for simpler and more economical manufacturing and installation of the present invention.

Also as shown in FIGS. 2 and 4, it is preferred that the object support rail 18 have top and bottom radially curved surfaces 24 and 26. It is preferred that the top and bottom curved surfaces have radii of ½ the width of the object support rail 18 to provide continuous curved surfaces. The bottom curved surface 26 is designed to afford a pleasing aesthetic aspect and is not designed to have any particular function. However, the top curved surface 24 is designed to act as a saddle-receiving surface which will removably and slidably accommodate the bracket 50 of the present invention as shown in FIG. 3.

The outer surface 28 of the object support rail 18 preferably includes two parallel channels 30*a* and 30*b* (FIG. 2) spaced equidistantly from the center longitudinal axis 32 of the object support rail 18. It is preferred that the spacing between the parallel channels 30*a* and 30*b* be between one-half inch and one inch. Between the channels and aligned with the center longitudinal axis 32 is a kerf 34, which is a deep narrow channel formed extending inward from the outer surface 28 into the object support rail 18. It is preferred that the parallel channels 30*a* and 30*b* not extend into the object support rail 18 as far as the kerf 34. It is preferred that the width of each parallel channel be between one-quarter inch and one-half inch and the width of the kerf 34 be between one-eighth inch and one-quarter inch. The parallel channels 30*a* and 30*b* are designed to accept the heads 36*a* and 36*b* of fastening devices 38*a* and 38*b*, thus allowing the heads 36*a* and 36*b* to be below the level of the outer surface 28 of the object support rail 18. The kerf 34 is designed to accept a "T" barbed bumper mould 40, as shown in FIGS. 2 and 4, the barbed section 42 designed to fit into the kerf 34 while the bumper section 44 is designed to cover the kerf 34 and both parallel channels 30*a* and 30*b*.

At each end of the object support rail 18, an end cap 46 may be provided as shown in FIGS. 1 and 2. The end cap 46 is preferably secured in place by a pair of end cap screws 48*a* and 48*b*. The end 46 serves two functions, the first being to prevent the bracket 50 from sliding off of the end of the object support rail 18 and second to provide a more finished appearance to the object support rail 18 and wall rail apparatus 10 in general.

Figure 3:
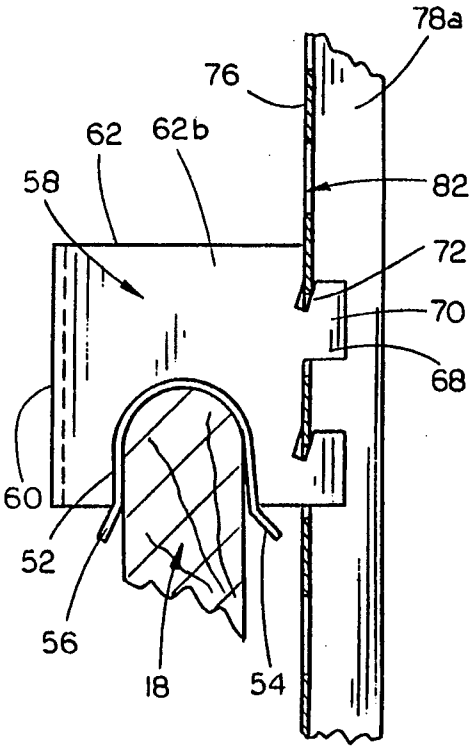
FIG. 3 is an enlarged partial side sectional view showing a cabinet mounted standard and saddle brackets supported on a support rail.

The bracket 50 is shown in its preferred embodiment in FIGS. 2 and 3 as including a curved saddle plate 52 which is shaped to fit over the top curved surface 24 of the object rail 18. It is preferred that the curved saddle plate 52 have a horizontal width between 1" and 2" to provide sufficient support for objects supported by the bracket 50, however, this dimension is not critical. It is preferred that the curved saddle plate 52 have a lower curved surface similar but not identical to the top curved surface 24 of the object support rail 18 and also include front and rear flanges 54 and 56 which act to guide the curved saddle plate 52 onto the top curved surface 24 of the object support rail 18. The reason it is preferred that the curved saddle plate 52 not have a curved shape identical to the top curved surface 24 of the object support rail 18 is to allow a small degree of pivotal motion of the bracket 50 thus allowing levelling of objects supported thereby.

Mounted on top of the curved saddle plate 52 is a U-shaped hook support 58 having a base section 60 and two forwardly extending arms 62*a* and 62*b* each having a section removed from the lower edges thereof to allow the U-shaped hook support 58 to fit over and accommodate the curved saddle plate 52. In the preferred embodiment, the height of the base 60 of the U-shaped hook support 58 would be between one inch and two inches and the length of each of the forwardly extending arms 62*a* and 62*b* would likewise be between one and two inches.

Mounted on the front edges of the forwardly extending arms 62*a* and 62*b* are four bracket hooks 64*a*, 64*b*, 66*a* and 66*b* (FIG. 2), two mounted on each forwardly extending arm 62*a* and 62*b*. As shown most clearly in FIG. 3, each bracket hook 64*a*, 64*b*, 66*a* and 66*b* includes a generally rectangular outward extension section 68 and an upwardly extending tooth section 70. The tooth section 70 is spaced from the front edge of the forwardly extending arm 62*a* to provide a sloped channel 72 which is angled inward towards the base 60 of the U-shaped hook support 58, as shown in FIG. 3. It is preferred that the curved saddle plate 52 slidably engage the top curved surface 24 of the object support rail 18 to allow for minor horizontal adjustments in the placement of objects supported thereon.

The bracket hooks 64*a*, 64*b*, 66*a* and 66*b* are designed to fit into and be held within a double slotted standard 74 as shown in FIGS. 2 and 3. The double slotted standard 74 is preferably a wide U-shaped channel having a wide flat base 76 and parallel arms 78a and 78b extending perpendicularly outward from the base 76. The base 76 preferably includes a plurality of counter-sunk screw receiving holes 80 and a plurality of slots 82 arranged horizontally in rows of two slots and vertically in two parallel columns, as shown in FIG. 2. Each slot 82 is preferably of sufficient height to accept a bracket hook 64*a*, 64*b*, 66*a* and 66*b* as shown in FIG. 3. Each of the bracket hooks 64*a*, 64*b*, 66*a* and 66*b* may then be moved upwards in relation to the double slotted standard 74 thus directing the section of the base 76 between each slot 82 into the sloped channel 72 between the forwardly extending arms 62*a* and 62*b* and upwardly extending tooth section 70. The slope of the sloped channel 72 causes frictional contact between the tooth section 70 and the base 76 of the double slotted standard 74 and also causes frictional contact between the forwardly extending arms 62*a* and 62*b* and the base 76 of the double slotted standard 74. This frictional contact results in there being less of a chance of accidental dislodgment of the double slotted standard 74 from the U-shaped hook support 58. The frictional contact is best shown in FIG. 3.

Of course, it is to be understood that the double slotted standard 74 may be replaced by a single slotted standard or any other such standard, with the necessary changes being made to the hooks 64*a*, 64*b*, 66*a* and 66*b* to fit therein. However, it is preferred that the double slotted standard 74 be used.

The U-shaped hook support 58, curved saddle plate 52 and double slotted standard 74 are all preferably constructed of hardened, tempered steel or stainless steel to provide the required strength, as the weight of all objects to be supported rests directly on these elements. However, any other such strong materials may be substituted for the stainless steel, as long as the tensile strength of the material is similar or greater.

It is preferred that the double slotted standard 74 be mounted to the rear surface 73 of the object 49 to be supported, be it a desk, cabinet or other such furniture. The slotted standard 74 is preferably mounted with the slots 82 in vertical alignment, as shown in FIG. 2, the mounting being accomplished by a plurality of countersink-head screws 84*a* and 84*b* screwed into the rear surface 73 of the object 49 to be supported. It is preferred that the double slotted standard 74 be of approximately 12 inches in length to provide a high degree of height adjustability, however, the exact dimensions of the double slotted standard 74 are not critical as long as the spacing between the slots 82 is identical to the spacing between the bracket hooks 64*a*, 64*b*, 66*a* and 66*b*.

Additionally, a leveling device 86 may be provided to level the top surface 87 of the object 49 being supported by the wall rail apparatus 10. A preferred example of such a leveling device is shown in FIG. 2 as including a threaded socket 88 formed in the rear surface 73 of the object 49 to be supported and an adjustable threaded leveling screw 90 adapted to be screwed into the socket 88. It is preferred that the leveling screw 90 include a slotted end 91 which may project through the threaded socket 88 to provide for adjustment of the leveling device 86 without requiring repositioning of the object 49 being supported. A wall surface bumper 92 may be provided on the opposite end of the leveling screw 90 to prevent damage to the wall surface 16 on which the wall rail apparatus 10 is mounted.

Figures 6, 7:
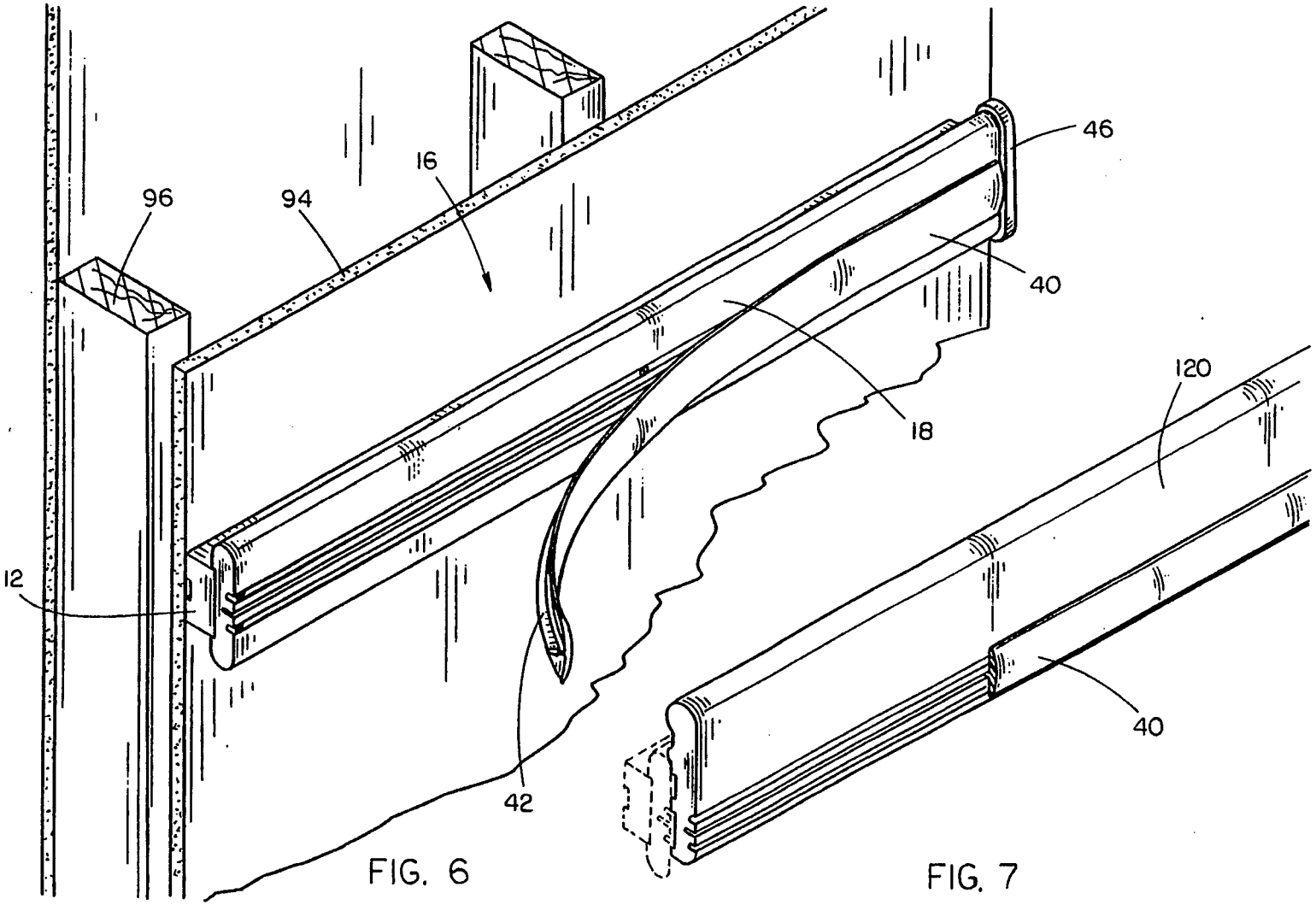
FIG. 6 is a foreshortened perspective view of the wall rail apparatus with portions broken away for clarity.
FIG. 7 is a front perspective view of the handrail of the invention with the wall rail apparatus indicated in dotted lines.

FIGS. 4 and 6 exhibit the preferred mounting technique for the wall rail apparatus 10 of the present invention. As shown in FIG. 4, the fastening screws 38*a* and 38*b* extend through the object support rail 18 through holes in the wall mount spacer board 12 and are screwed into the drywall surface 94 and into a stud 96 or other such backing board behind the drywall 94. The length of the fastening screws 38*a* and 38*b* should be sufficient to extend into the stud 96 at least one inch and preferably greater than one inch to provide sufficient support for the wall rail apparatus of the present invention. Of course, it is very important that the wall mount spacer board 12 and object support board 18 be in substantially parallel alignment and be fastened to the wall surface 16 such that the center longitudinal axis 32 of the object support rail 18 be as close to horizontal as possible to provide maximum support for objects 49 supported thereon. FIG. 6 exhibits the wall rail apparatus 10 mounted on a wall surface 16 with the fastening devices 38*a* and 38*b* extending into studs 96. As is most clearly shown on FIG. 4, the heads 36*a* and 36*b* of the fastening devices 38*a* and 38*b* are sunk into parallel channels 30*a* and 30*b* to provide a generally flat surface to accommodate the "T" barbed bumper 40.

Figure 8:
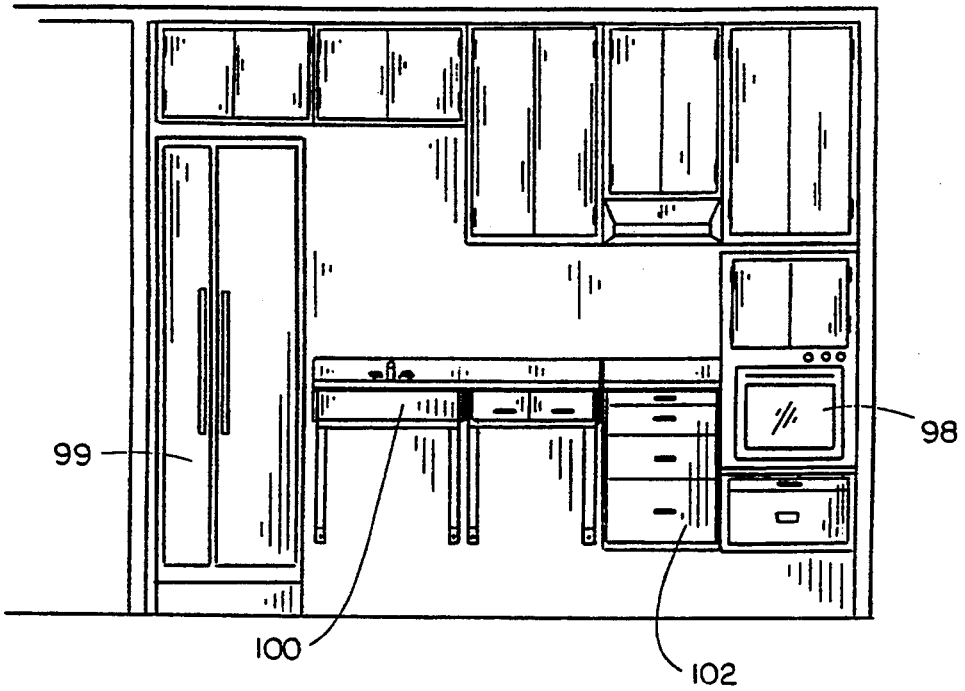
FIG. 8 is a front elevational view of an arrangement of casegoods mounted on the rail apparatus in an elevated position.
Figure 9:
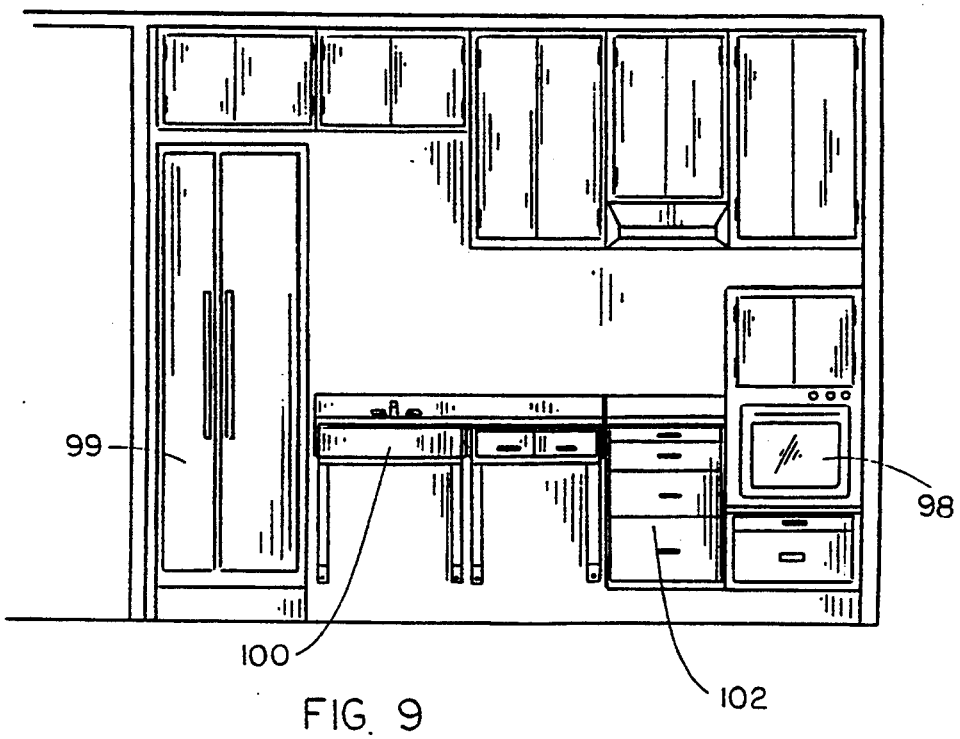
FIG. 9 is a front elevational view of a selection of casegoods mounted on the rail apparatus in a lowered position relative to FIG. 8.

FIGS. 8–14 exhibit various embodiments of the present invention. FIGS. 8 and 9 exhibit the wall rail apparatus 10 of the present invention being used in a kitchen, thus providing adjustable support for various kitchen structures, such as the oven 98, side-by-side refrigerator 99, sink 100 and cabinets 102. FIG. 8 exhibits the various structures 98, 100 and 102 in higher position than shown in FIG. 9, thus exhibiting the height adjustment feature of the present invention.

Figure 10:
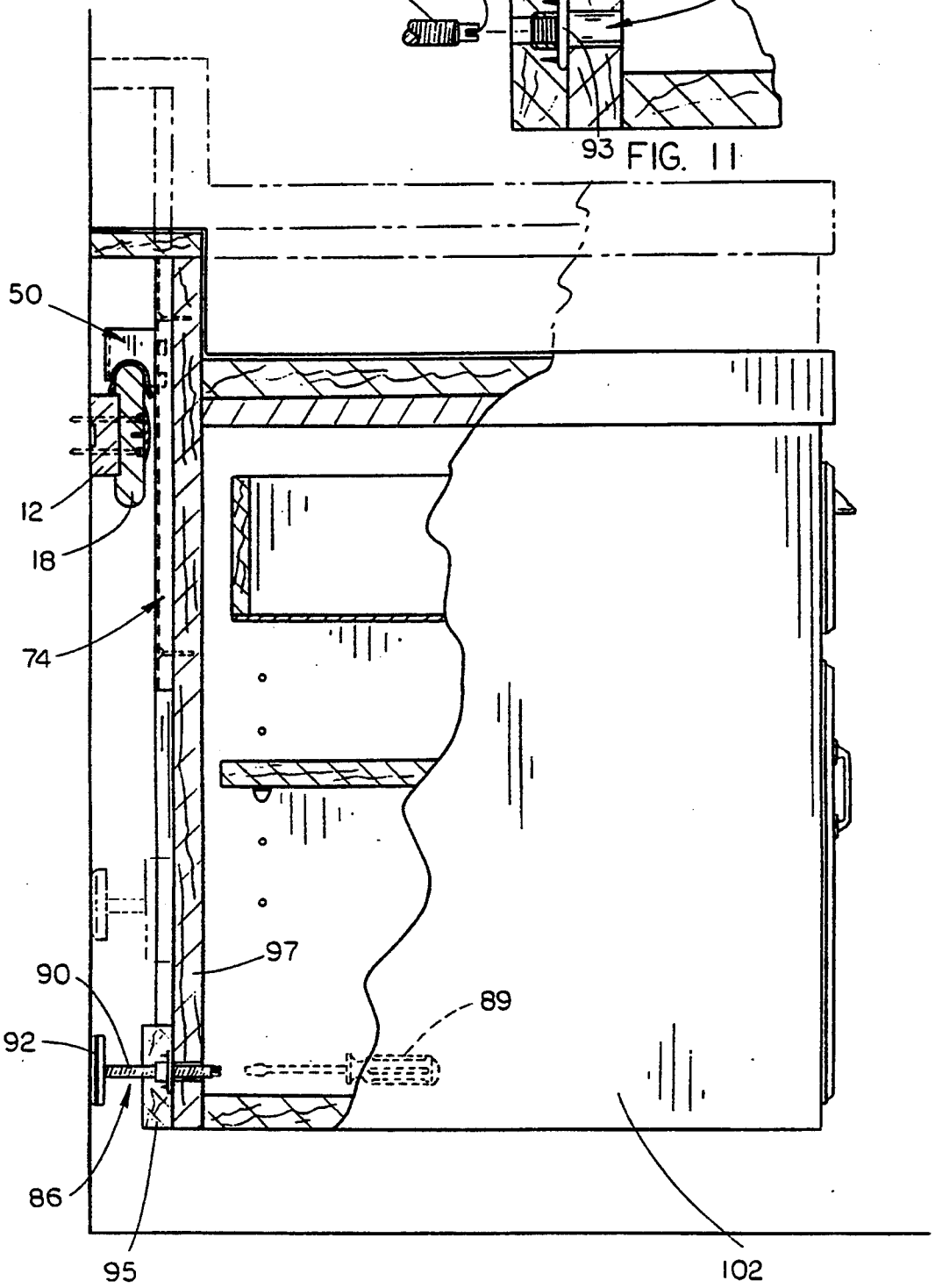
FIG. 10 is a sectional side elevational view showing the adjustable mounting of a cabinet on the wall rail apparatus of the invention.

FIG. 10 is a side view of the cabinets 102 showing the height adjustable mechanism in operation with the various elements of the wall rail apparatus 10 clearly exhibited. It is preferred that base cabinets will be height adjustable from 28 inches to 36 inches. In one preferred embodiment, such base cabinets will be 24 inches high from bottom to top of the countertop, therefore, a cabinet top 28 inches off the floor will have a four-inch toe space and one 36 inches off the floor will have a twelve-inch toe space, with many variations in height and toe space possible between these values. However, it is to be understood that this is only one preferred embodiment, as many different types of cabinets and lengths of standards may be used. It is important that the leveling device 86 as installed on the cabinet 102 may be adjusted by using a screwdriver 89 inserted into the slotted end 91 of the leveling screw 90, as shown in FIG. 10.

Figure 11:
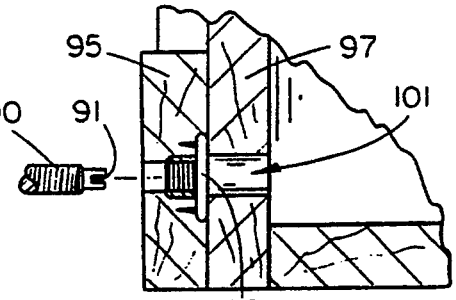
FIG. 11 is a partial detail side elevational view of the leveling device mounted on a cabinet.

FIG. 11 is an expanded view of the leveling device 86 on the cabinet 102 showing the preferred installation. A hole 101 is formed in the rear wall 97 of the cabinet 102 adjacent the cabinet base. A T-nut 93 is secured over the hole 101 by a rectangular block 95 also having a hole. The block 95 may be secured in place by any fastening means such as screws or glue. In this manner, the leveling device 86 may be adjusted from the interior of the cabinet 102.

Figure 13:
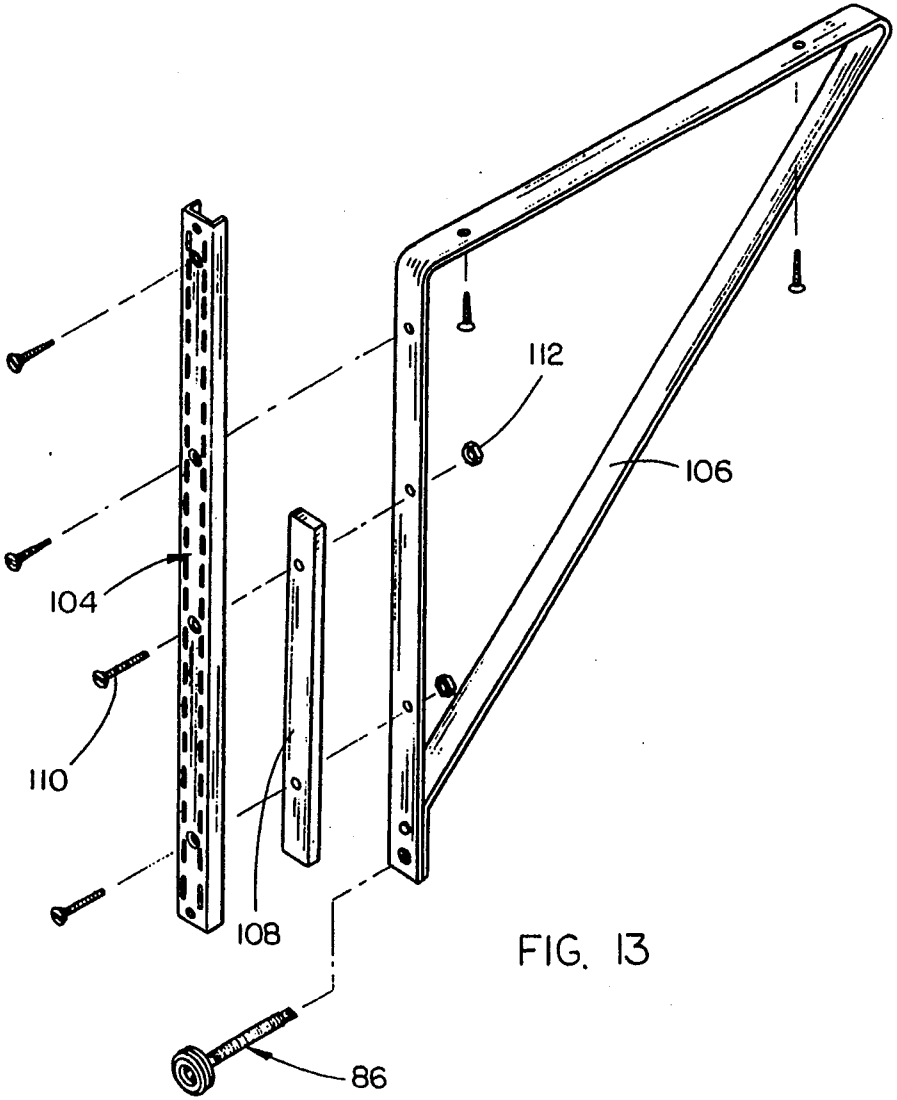
FIG. 13 is a perspective view of the triangular support bracket of the invention.
Figure 12:
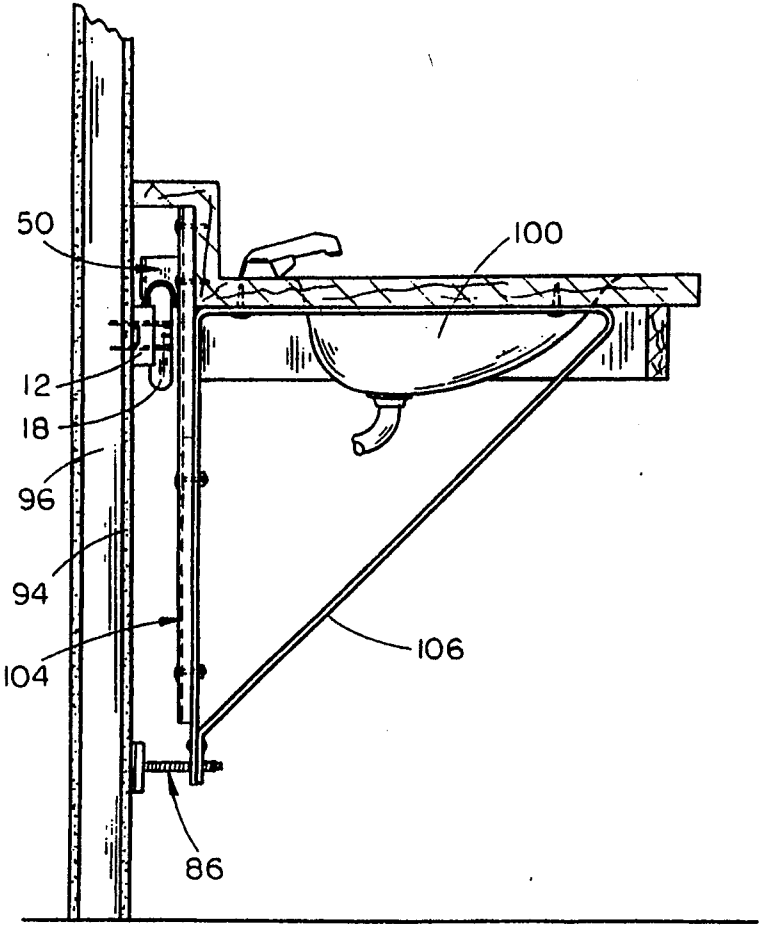
FIG. 12 is a side sectional view of a sink set within a countertop mounted on triangular support brackets to which the standards are secured for height adjustable connection to the rail apparatus.

FIGS. 12 and 13 exhibit the wall rail apparatus 10 in use with a sink assembly 100. It is preferred that the sink assembly include a longer standard 104 and a triangle bracket 106, one mounted on each side of the sink 100. In the preferred embodiment, a wooden spacer 108 is provided between the standard 104 and triangle bracket 106 to allow sufficient space for the bracket hooks 64*a*, 64*b*, 66*a* and 66*b* to be inserted into the standard 104. Each triangle bracket 106 also includes a leveling device 86 as previously described. The bracket 106 and standard 104 are connected to one another by bolts 110 and nuts 112 substantially as shown in FIGS. 12 and 13, although the exact placement of the bolts 110 and nuts 112 is not critical to the invention. It is preferred that triangle bracket 106 be constructed of a sturdy metal such as steel or aluminum, which is bent to form the triangle shape of the triangle bracket 106.

Figure 15:
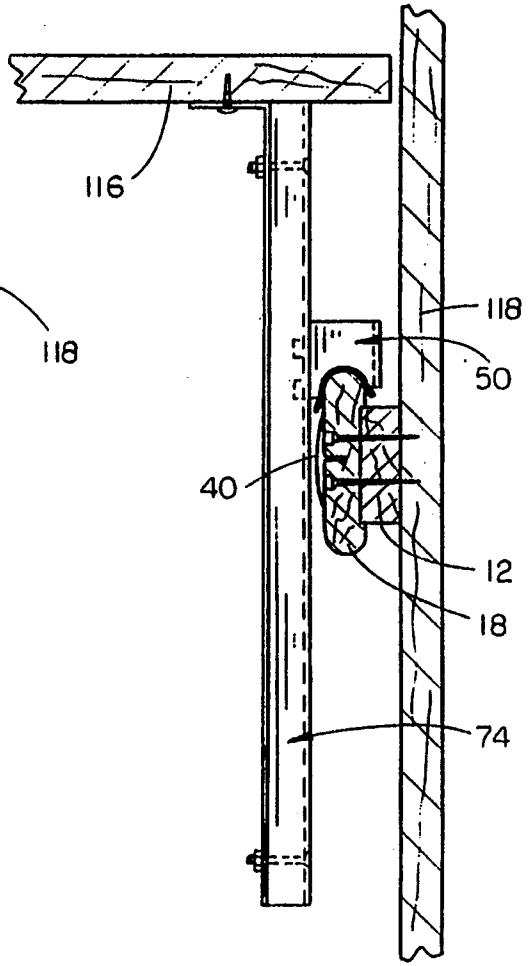
FIG. 15 is a partial enlarged side sectional view showing the height adjustable connection of the desk top to the rail apparatus.
Figure 14:
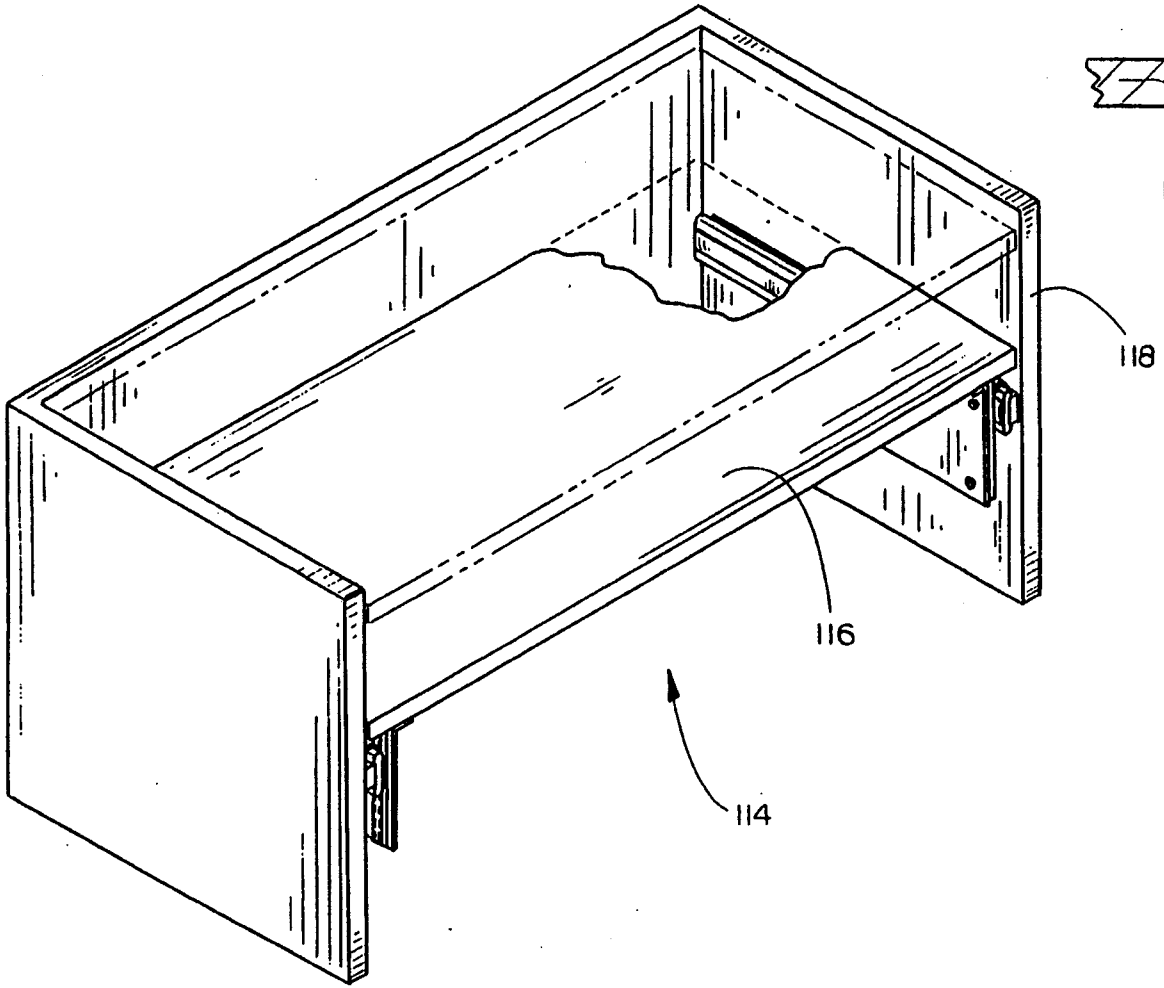
FIG. 14 illustrates an alternate embodiment of the invention wherein the rail apparatus is mounted on the interior sidewalls of a desk for height adjustable support of the desk top.

FIGS. 14 and 15 exhibit an embodiment of the present invention adapted to create an adjustable height desk 114. FIG. 13 exhibits the desk top, as mounted on object support rails 18, in a lowered position shown by the dotted lines and in a raised position shown by the dotted lines. The adjustment in height is performed in the same manner as described in connection with the first embodiment, i.e. the bracket 50 being moved to a different location on the double slotted standard 74. Additionally, depending on the position of the brackets 50 in relation to the open edge of the desk, the desk top may be slid towards a person seated in front of the desk, thus enabling easier use of the desk top area 116. It is preferred that the side walls 118 of the desk 114 be of sufficient thickness to accept the fastening devises 38*a* and 38*b* without the ends of the fastening devices 38*a* and 38*b* extending through the side walls 118. There is thus provided a desk 114 having a desk top 116 which may be easily and quickly adjusted in the vertical plane.

The present invention thus furnishes a safe practical system to provide cabinetry, desk tops and other such furniture that will be adjustable in height to comply with the Uniform Federal Accessibility Standards by the Architectural Barriers Act of 1968, as amended. Problems often encountered with objects placed on the floor thus may be prevented, such as unsightly indentations being formed in carpets and scraping of floor surfaces. Furthermore, as the present invention provides a leveling mechanism, desks and tables may be used even in places having uneven floor surfaces. Furthermore, the present invention uses standard slotted shelf standards which may be quickly and easily installed on a variety of furniture and cabinets, thus providing increased cost savings over examples found in the prior art. As the present invention also requires that few holes be formed in wall surfaces for mounting the wall rail apparatus 10, less damage is done to vertical wall surfaces 16 than is done by examples found in the prior art. Additionally, the present invention provides an aesthetically pleasing rail surface, as it is proposed to use hardwoods to form the object support rail 18. The present invention also provides advantages discussed previously in the summary of the invention.

Figure 5:
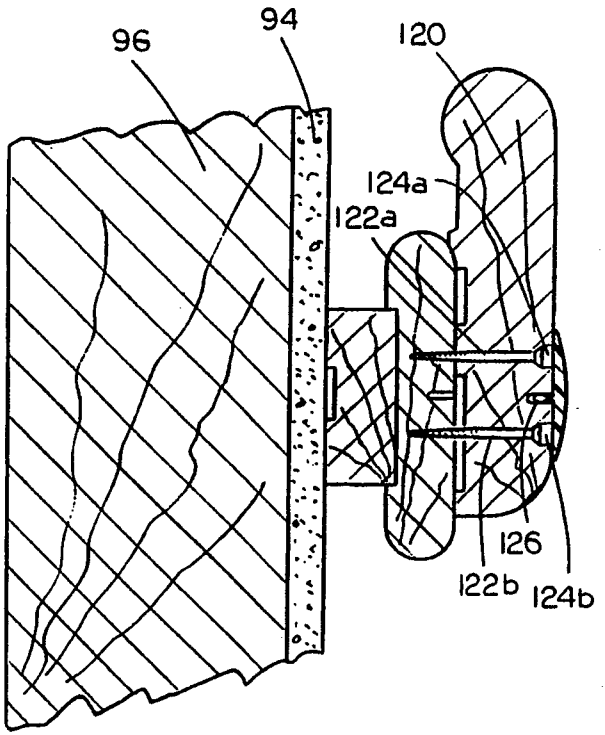
FIG. 5 is a partial side sectional view showing the handrail assembly of the present invention.

The present invention may also be modified to include a hand rail 120 as shown in FIGS. 5 and 7. The hand rail 120 is added to the outer surface 28 of the object support rail 18 after the "T" barbed bumper mould 40 is removed from the outer surface 28. The hardwood hand rail 120 is then positioned on the outer surface 28 and secured in place by fastening screws 122*a* and 122*b* which fit into parallel channels 124*a* and 124*b* on the hand rail 120 similar to parallel channels 30*a* and 30*b* found on the object support rail 18. The fastening screws 122*a* and 122*b* are intended to penetrate into the object support rail 18 to secure the handrail 120 in position. Also, the hand rail 120 includes a kerf 126 similar to kerf 34 found on the object support rail 18 for accommodating the "T" barbed bumper mould 40 as was previously described in connection with object support rail 18. In this manner, the wall rail apparatus 10 may be modified to include a hand rail 120. Therefore, in places where objects are not being supported on the wall rail apparatus 10, the wall rail apparatus 10 may include the hand rail 120 to provide assistance for the infirm or handicapped who are using the present system. This simple modification from wall rail support apparatus 10 to hand rail 120 is not shown in the prior art and thus presents a distinct advantage over those devices found in the prior art.

It is to be understood that the present invention may be modified in many ways, such as forming each of the elements out of various materials and modifying the exact dimensions of the elements as they appear in the preferred embodiment. However, it is also to be understood that the above description is not intended in any way to limit the scope of the present invention, which follows in the claims set forth below.

There has thus been set forth and described an invention which accomplishes the stated objectives.

I claim:

1. An apparatus for height adjustably supporting an object on a wall surface, said apparatus comprising:

a longitudinally extended support rail including a wall mount spacer section comprising a board having a generally rectangular cross-section, a center longitudinal axis, an outer side and an inner side, said inner and outer sides of said wall mount spacer section corresponding to opposite wider sides of said wall mount spacer section, said inner side adapted to be mounted adjacent a wall surface, and an outer support section having an outer side, an upper surface and a center longitudinal axis, said support section and said wall mount spacer section connected together such that said support section is spaced from a wall surface on which said wall mount spacer section is mounted, said center longitudinal axis of said outer support section aligned substantially parallel with said center longitudinal axis of said wall mount spacer section;

said upper surface of said outer support section spaced from said wall mount spacer section whereby a saddle-receiving upper surface is formed;

at least one object-supporting saddle bracket adapted to fit over and be supported by said saddle-receiving upper surface of said support section, said saddle bracket further comprising engagement means for engaging and supporting an object adjacent said outer side of said support section; and receiving means for receiving and retaining said engagement means, said receiving means adapted to be mounted on an object for enabling an object to be supported by said apparatus, wherein said wall mount spacer section comprises a board having a generally rectangular cross-section and an outer side, said inner and outer sides of said wall mount spacer section corresponding to opposite wider sides of said wall mount spacer section.

2. The apparatus of claim 1 wherein said outer support section comprises a board having rounded top and bottom surfaces and an inner side, said outer support section extending above and below said wall mount spacer section whereby a stable, sturdy object support surface may be provided.

3. The apparatus of claim 1 wherein said outer support section further comprises a resilient strip mounted on said outer side of said object support rail to act as a bumper guard for said outer support section from damage from objects supported therefrom.

4. The apparatus of claim 2 wherein said outer support section further comprises a dado, a shallow, rectangular channel extending into said inner side, said dado adapted to receive said outer side of said wall mount spacer section in press-fit relation thereby to strengthen the connection between said wall mount spacer section and said object support section.

5. The apparatus of claim 1 wherein said object-supporting saddle brackets each comprise a curved plate for engaging said saddle-receiving upper surface of said outer support section, said curved plate adapted to have a lower surface having similar curvature to the curvature of said saddle-receiving upper surface, and said engagement means on said object-supporting saddle brackets each comprise at least one hook mounted on said curved plate adjacent said outer Side of said support rail for engaging said receiving means, said hook comprising an outwardly extending plate section and an upwardly extending tooth section mounted on the outer end of said plate section.

6. The apparatus of claim 5 wherein said receiving means comprises a slotted standard mounted on an object to be supported, said slotted standard adapted to receive said hook in a slot on said slotted standard and secure said hook therein, whereby an object may be supported by said hook.

7. The apparatus of claim 6 wherein said slotted standard comprises a U-shaped channel having a base and generally parallel arms extending therefrom, said base having at least one row of slots formed therein for accepting and retaining a hook on said saddle bracket, said row of slots generally parallel with said arms.

8. The apparatus of claim 7 wherein said standard base has two generally parallel rows of slots and said saddle bracket further comprises a plurality of hooks, said hooks arranged horizontally in pairs and in a pair of parallel vertical columns such that a plurality of hooks engage said slotted standard to provide secure support for an object being supported thereby.

9. The apparatus of claim 8 wherein said engagement means further comprises a U-shaped plate mounted on said curved plate, said U-shaped plate having a base and two arms mounted thereto, said U-shaped plate mounted such that said base of said plate is generally upright, said hooks mounted on said arms opposite said base, said tooth section of each hook spaced from said arm on which each hook is mounted, said tooth section and said arm forming a slanted channel therebetween, said hooks operative to be inserted into said slotted standard, said slotted standard being moved downwards such that said tooth sections extend behind said base of said slotted standard, said slotted standard being frictionally received in said slanted channel for secure support thereon.

10. The apparatus of claim 9 further comprising leveling means including an adjustable threaded nut mounted towards the base of an object to be supported and a threaded bolt to extend therethrough, said bolt extending rearward for adjustably spacing an object from a wall surface whereby an object may be levelled relative to a floor surface.

11. An apparatus for height adjustably supporting an object on a wall surface, said apparatus comprising:

rail means including;

a longitudinally extended wall mount spacer section having a center longitudinal axis and having inner and outer sides, said inner side adapted to be mounted adjacent a wall surface;

a longitudinally extended object support rail having inner and outer sides, an upper surface and a center longitudinal axis, said inner side of said support rail adapted to be mounted adjacent said outer side of said wall mount spacer section, said center longitudinal axis of said object support rail aligned substantially parallel with said center longitudinal axis of said wall mount spacer section;

said upper surface of said support rail spaced from said wall mount spacer section whereby a saddle-receiving upper surface is formed;

handrail means having a center longitudinal axis and an inner side adapted to be mounted adjacent said outer said of said object support rail, said handrail means extending above said object support rail, said center longitudinal axis of said handrail means aligned substantially parallel with said center longitudinal axis of said object support rail.

12. A method for height adjustably supporting an object on a wall surface, said method comprising the steps:

providing rail means including a longitudinally extended wall mount spacer section which has mounted adjacent thereto a longitudinally extended object support rail, said support rail having a saddle-receiving upper surface spaced from said wall mount spacer section, at least one object-supporting saddle bracket adapted to fit over and be supported by said upper surface of said support rail, said saddle brackets further including hook means for engaging a slotted standard, said slotted standard having a front face and a plurality of slots formed therein for accepting and retaining said hook means therein;

mounting said slotted standard on an object to be supported;

inserting said hook means on said saddle bracket into said slots on said slotted standard;

adjusting said saddle bracket relative to said slotted standard such that said hook means are positioned behind said front face and in frictional contact therewith, said hooks projecting upwards behind said front face;

mounting said wall mount spacer section on a vertical wall surface in substantially horizontal alignment;

mounting said object support rail adjacent said wall mount spacer section, said wall mount spacer section and said object support rail mounted on a wall surface in generally parallel alignment with one another; and hanging said saddle bracket on said upper surface of said support rail thereby supporting an object.

* * * * *